US005713587A

United States Patent [19]

Morrow et al.

[11] Patent Number: 5,713,587

[45] Date of Patent: Feb. 3, 1998

[54] ATTACHMENT SYSTEM FOR SNOWBOARDS

[75] Inventors: Robert J. Morrow; Neil E. Morrow, both of Salem, Oreg.

[73] Assignee: Morrow Snowboards, Inc., Salem, Oreg.

[21] Appl. No.: 514,122

[22] Filed: Aug. 11, 1995

[51] Int. Cl.[6] ..... A63C 9/00

[52] U.S. Cl. ..... 280/14.2; 280/623; 280/633

[58] Field of Search ..... 280/607, 617, 280/618, 619, 623, 627, 633, 11.3, 11.36, 142; 36/117, 120, 125

[56] References Cited

U.S. PATENT DOCUMENTS

| | | | |
|---|---|---|---|
| 1,312,739 | 8/1919 | Leblanc | 280/11.3 |
| 3,636,642 | 1/1972 | Walther | 36/120 |
| 3,861,067 | 1/1975 | Koyama et al. | 36/120 |
| 4,096,651 | 6/1978 | Ancker | 36/120 |
| 4,178,013 | 12/1979 | Bataille | 280/618 |
| 4,709,491 | 12/1987 | Morell et al. | 36/120 |
| 4,896,895 | 1/1990 | Bettosini | 280/618 |
| 4,973,073 | 11/1990 | Raines et al. | 280/14.2 |
| 4,979,760 | 12/1990 | Derrah | 280/607 |
| 5,401,041 | 3/1995 | Jespersen | 280/623 |
| 5,520,406 | 5/1996 | Anderson et al. | 280/633 |

FOREIGN PATENT DOCUMENTS

| | | | |
|---|---|---|---|
| 41 12 299 | 12/1991 | Germany | 280/607 |

*Primary Examiner*—Richard M. Camby
*Assistant Examiner*—Frank Vanaman
*Attorney, Agent, or Firm*—Dellett and Walters

[57] ABSTRACT

A snowboard binding system employs a frame system which substantially encloses the boot and includes at least two attachment points for engagement by a corresponding binding portion mounted to the snowboard. Mounts engage the corresponding binding cables on the board. The binding system includes anchor straps for adjusting snugness of the boot to the binding frame and adjustable toe contact cable which in conjunction with a forward-lean slide and adjustment member enables variable pivot point selection at the front of the binding system. An adjustable highback pivotally mounts to the binding frame. The adjustment straps enable control of tension for medial and lateral leaning to further provide a variation of the binding system control as desired by the rider. Further, the boot sole remains flexible, since no rigid plate or the like is employed.

10 Claims, 8 Drawing Sheets

ATTACHMENT SYSTEM FOR SNOWBOARDS

This invention relates to snowboarding, and more particularly to an improved attachment system for securing the snowboard rider to the snowboard.

BACKGROUND OF THE INVENTION

The sport of snowboarding is an increasingly popular wintertime activity wherein a snowboarding enthusiast (hereinafter "snowboarder") maneuvers the board down a snow-covered slope while standing thereon. To facilitate snowboard maneuvers, the snowboarder requires intimate association with the board and therefore bindings are used for securing the snowboarder's boots to the board.

Boots for snowboarding are characterized as either soft or hard. Soft boots employ a flexible shell to permit foot/ankle flexing. Hard boots have similar insulating features, but have a hardened outer shell more particularly suited for specific applications such as downhill skiing. The standard downhill ski boot is worn by a skier for obtaining a rigid association between the skier's feet and lower legs and the downhill ski. In snowboarding, on the other hand, the snowboarder usually desires tight coupling to the snowboard for assisting board manipulation, but at the same time desires a greater degree of freedom for foot/ankle flexing. Unlike downhill skiing, wherein the boots attach to left and right skis with the toes pointed along the respective longitudinal axes, the boots for snowboarding are mounted to the snowboard so that the snowboarder stands over the board with the toes pointed primarily perpendicular to the longitudinal axis with the feet spaced apart from one another beyond shoulder width. With such foot placement, the methods used for manipulating the snowboard generally require that the snowboarder be permitted a great degree of freedom for foot/ankle flexing.

At least two different types of bindings are available for securing boots to a snowboard depending upon the type of boot worn, i.e., hard and soft. Known hard boot bindings use separate toe and heel pieces which bolt to the snowboard via a mounting plate. The toe piece has an engagement clamp for seating a specifically molded toe projection of the hard boot while the heel piece has a clamping bracket, an engagement lever, and a release lever. The clamping bracket releasably engages a molded heel protrusion of the hard boot when the boot is inserted into the binding, the heel of the boot depressing the engagement lever. In order to release the boot from the binding, the release lever is actuated for releasing the heel bracket so that the skier or snowboarder may step out of the hard boot binding. Other hard boot bindings may be one piece and may engage the heel of the boot only, for example.

The elements of a soft boot binding include an optional cant, a seating frame including toe and ankle straps and a calf support, known as a highback. The cant supports the frame and comprises a rectangular block which has a flat upper surface sloped relative to its flat bottom surface. The seating frame includes a plate, a heel bracket, and a toe strap mounting bracket. The plate has a pattern of holes for passing bolts used in mounting the plate to the snowboard, or alternatively to the optional cant. Another popular binding style uses a mounting plate with a relatively large hole in the center, with a corresponding disk, which engages the mounting plate hole. The disk is bolted to the snowboard and thus secures the mounting plate to the board. The boot is held to the board by interaction with the binding plate.

The toe and ankle straps of the soft boot binding have essentially identical elements and functionality except that the length of the ankle strap is generally longer than that of the toe strap. Each strap cooperates with the seating frame for strapping over respective toe and ankle portions of a boot for securing the boot to the frame.

The known binding systems, however, are somewhat constraining in that they employ a fixed stance and a fixed flexibility for leaning and side-to-side movements. As a rider becomes more skilled at snowboarding, it is often desired to be able to adjust the action of the binding such that the forward lean, i.e., the angle of the rider's leg with respect to the horizontal plane, is adjusted. Further, the rider may often wish to change the stance orientation with respect to the board, the stance width, the rotation of the rider's feet or the relative centering of the boot with respect to the board, such that different maneuvers are possible. For example, the rider may wish a differing amount of freedom for medial leans, i.e., inwardly toward the center of the rider's body, versus lateral leaning, i.e., away from the center of the rider's body. It is also desirable that the medial and lateral lean directions be substantially parallel to the longitudinal axis of the snowboard. Heretofore, such lean direction adjustment or lean tension with respect to the board has been fixed and would require replacement of the binding or adjustment of the highback to a different location along an adjustment slot to enable a different degree of freedom in any particular motion or direction. Similarly, the amount of forward lean has been somewhat fixed as well as the amount of force applied to pull the board upwardly when the rider leans backwardly.

In order to provide more control for advanced riders, soft boots have employed somewhat rigid soles therein in order to enable a firm engagement between the boot and binding. However, the addition of a rigid sole makes the boot uncomfortable and somewhat awkward for use when not riding on the snowboard, i.e., when walking. The plate in the bottom of the boot also isolates the rider's foot from the board, giving a feeling of less direct control since the rider's foot is not able to directly contact the board. It is desirable to have the bottom of the rider's foot as close to the board as possible, to provide a lower center of gravity.

SUMMARY OF THE INVENTION

In accordance with the present invention, a snowboard boot and binding system employs a structural cage which may be internally included within or external of a boot. The cage provides at least four contact points to the board at forward left and right and rearward left and right positions relative to the boot, but still allows an open bottom boot without use of a rigid plate therein. The binding system enables forward lean adjustment as well as control of lateral and medial lean parameters. The force attachment point for rearward leaning is adjustable along a continuum from the left to the right side of the boot to enable fine tuning of the binding system to a particular rider's preference.

It is accordingly an object of the present invention to provide an improved boot binding system which enhances a snowboard riding experience.

It is a further object of the present invention to provide a snowboard binding system which enables use of a soft boot without a rigid sole plate therein along substantially the entire bottom of the rider's foot.

It is yet another object of the present invention to provide a binding system for a snowboard which enables adjustment of the forward lean as well as the application point of force to the front of the binding relative to the boot.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
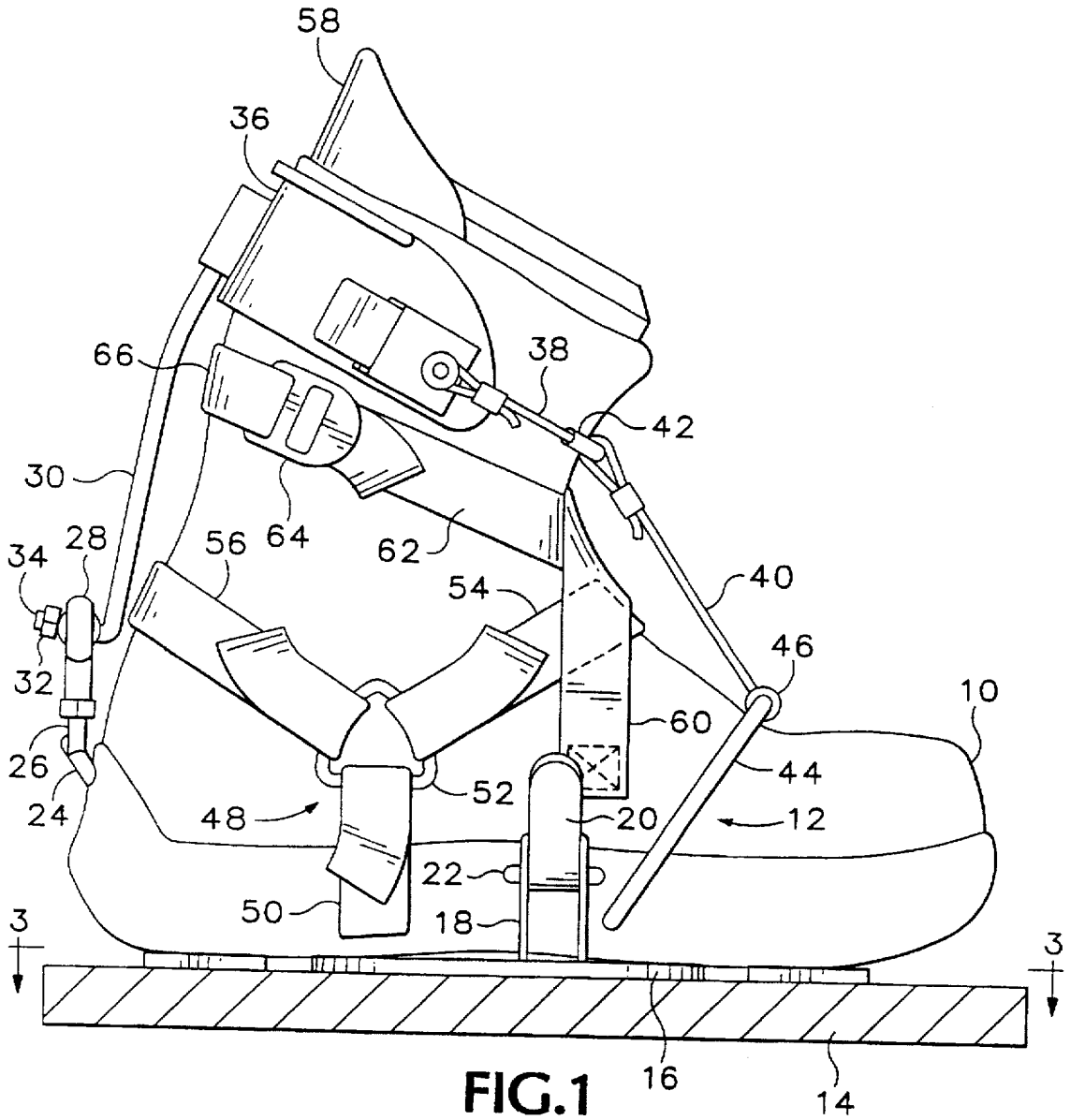
FIG. 1 is a lateral side view of a boot and binding system in accordance with the present invention.
Figure 2:
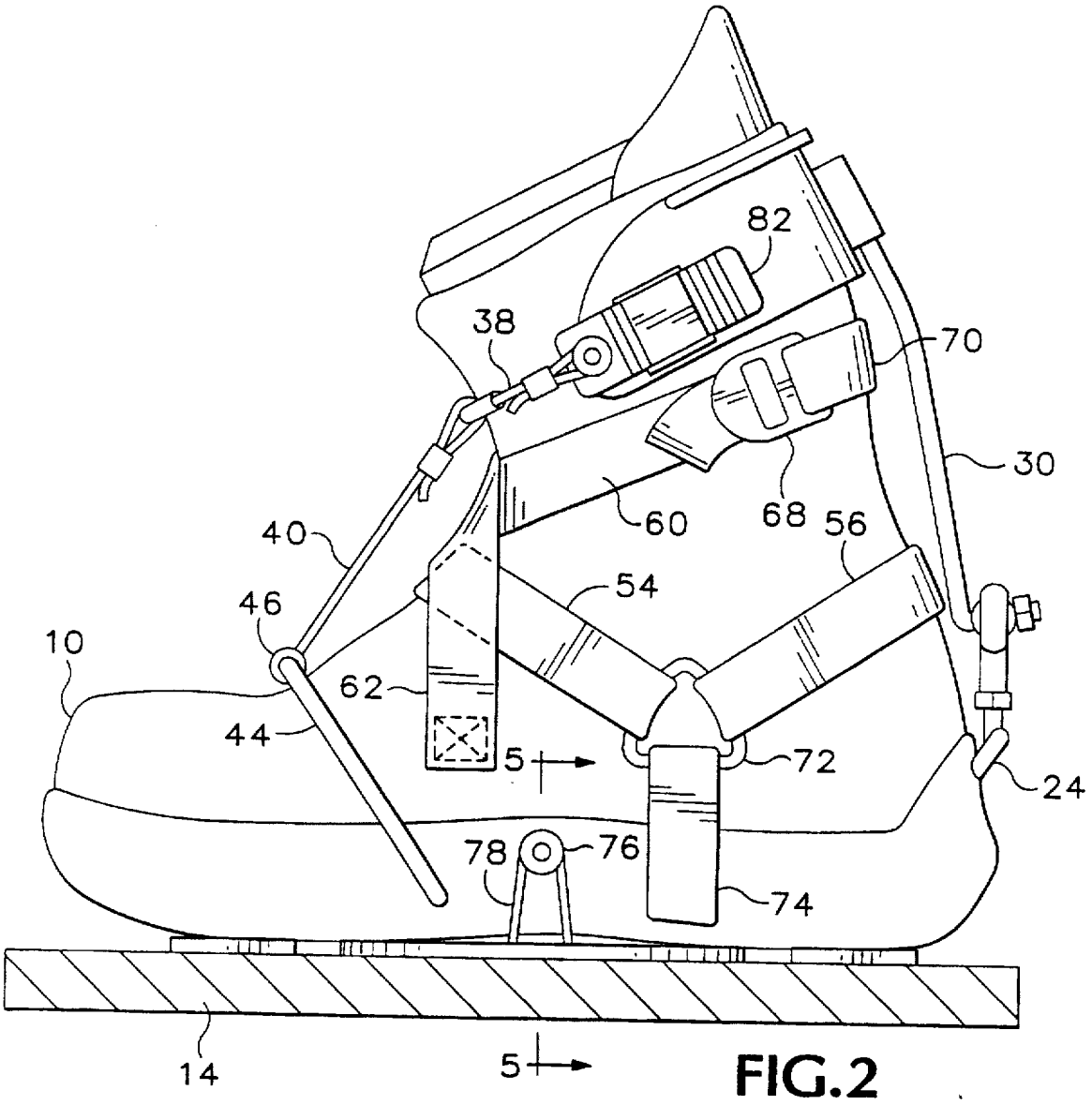
FIG. 2 is a view of the medial side of the boot and binding system of FIG. 1.

Referring to FIG. 1, which is a lateral side view of a boot and binding system in accordance with the present invention, the boot 10 incorporates a structural frame system 12 which is partially enclosed by portions of the boot in the illustrated embodiment. In use, the boot is held to a snowboard 14 via a mounting plate 16 which is suitably fastened to the board via screws, for example. A mounting element 18 is secured to the board by a mounting plate wherein a mounting buckle 20 receives the element 18 in sliding engagement. The mounting buckle is adapted to cooperate with side mount portion 22 which is a portion of the frame system 12. The buckle engages side mount portion 22 at the lateral side of boot 10, i.e., the side away from the body of the person wearing the boot. In general, side mount 22 is suitably positioned somewhat centrally of the boot with the medial side portion of the mount (FIG. 2) slightly closer to the heel than the lateral side portion. Towards the rear of the boot is heel loop portion 24 of the frame system wherein the heel loop portion extends from the rearward lateral side of the boot around the back heel portion of the boot to the medial side of the boot as shown in FIG. 2. Extending upwardly from heel loop 24, at a position slightly off the centerline of the boot, towards the lateral side thereof, is spine post 26 which has a multi-directional movement joint 28 mounted thereon. The joint receives highback post 30 wherein the post is secured to the joint via any suitable fastening means, for example a nut 32 engaging threaded portion 34 of highback post 30. The highback post bends at a substantially right angle as it leaves the joint and extends upwardly along the back of the boot, with a somewhat curved profile to conform to the forward tilt of the boot. In a particular embodiment, joint 28 comprises a ball joint, for example.

At the distal end of the highback post relative to the ball joint, a rigid calf loop 36 is securely fastened to the highback post. The calf loop extends forwardly and provides a somewhat semicircular or U-shaped profile for engaging with the calf of the person wearing the boot. A forward-lean loop member 38 attaches to the calf loop somewhat forwardly of the highback post and provides a member 38 which loops around the front portion of the boot to the medial side thereof. A forward-lean securement member 40 slidingly engages member 38 so as to slide along slide portion 42. The member 40 extends from slide portion 42 downwardly so as to engage toe loop portion 44 of the frame system wherein the toe loop substantially surrounds the toe end of the boot from the sole of the boot up over the top of the lateral side, down to the sole of the medial side. Member 40 is fastened in fixed relation to toe loop portion 44 by toe lock 46. The toe lock 46 may be unlocked in order to slidably translate along toe loop 44 and re-lock at a different position on the toe loop so as to change the attachment point of the forward-lean system (which comprises in cooperation member 40, slide 42, member 38, as well as the attachment of member 38 to rigid calf loop 36). The top of the toe loop and the top of the spine post 26 are at slightly different levels, the spine post top being higher to a small degree. Members 38 and 40 suitably comprise cables, but may be rope (synthetic or otherwise), webbing or other suitable material which is somewhat resistant to stretching and operates under tension rather than compression. Member 40 can comprise a ring type member, for example.

The boot-binding system further includes an anchor strap system 48. As shown in FIG. 1, for example, anchor system 48 is external of boot 10, but an alternative embodiment employs an internal anchor system. The anchor strap system 48 which includes strap portion 50 securely engaging a portion of anchor frame 12 (not visible in FIG. 1) at the lower end thereof and extending upwardly to D-type ring 52, folding back on itself and enabling length adjustment of the strap and securement via a hook and loop fastener arrangement. D-ring 52 is further engaged by forward strap 54 which extends over the front ankle portion of the boot from the medial side thereof, looping back upon itself through D-ring 52 wherein the strap 54 is secured to itself via hook and loop fasteners. One section of the strap carries the hook portion of the fastener and the other section of the strap carries the loop portion of the fastener, such that the two portions meet and engage. Rear strap 56 similarly wraps around the boot above the heel thereof from the rearward medial side and, after passing through D-ring 52, is secured by folding back upon itself via the use of hook and loop type fasteners. Ratchet type fasteners are employed in an alternative embodiment. The highback 58 extends upwardly substantially beyond the top edge of the rigid calf loop 36 and is suitably padded with a highback pad (not shown) to assure user comfort.

The boot 10 further includes a medial lean control strap 60 which attaches centrally of the boot slightly below the plane of the wearer's ankle bone on the lateral side of the boot, extending up over the front face of the boot to the medial side of the boot. The configuration of the strap at the medial side is described in conjunction with FIG. 2 hereinbelow. A lateral lean control strap 62 crosses the front face of the boot in a similar location to strap 60, traversing from the medial side of the boot to the lateral side whereupon the strap is looped through medial lean control D-ring 64 and folded back upon itself via the use of hook and loop type fasteners. In place of a hook and loop type arrangement, a friction type strap/buckle combination is employed for straps 60 and 62. Such friction type buckle and strap combinations are often employed with backpack straps. The tautness of the strap is accordingly adjustable by pulling the distal flap of the strap further through the friction buckle so as to cinch the strap tighter. The friction buckle 64 is suitably secured to the rear of the boot just below the location of the rigid calf loop 36 through use of strap 66 which engages the friction buckle. Strap 66 is secured to the boot by any suitable means, for example by reinforced sewing.

Referring now to FIG. 2, which is a view of the medial side of the boot and binding system of FIG. 1, it may be observed that lateral lean control strap 62 is attached to the boot in a manner similar to attachment of medial lean control strap 60, although on the opposite side of the boot, suitably the medial side. Strap 60 employs a similar securement system to strap 62 wherein a medial lean control friction buckle 68 is secured to the boot just below the location of rigid calf loop 36 through use of a support strap 70 suitably attached to the rear of the boot. Strap 60 is secured to its desired adjustment position by looping through friction buckle 68 and being pulled to its desired tension. Forward strap 54 and rearward strap 56 are suitably looped through D-ring 72 which is attached via medial attachment strap 74 to the frame system 12.

It will also be observed in FIG. 2 that the frame system includes a mounted cable engaging receptacle 76 which is adapted to engage mounting cable portion 78. The mounting cable is suitably attached and securely held to the board. Tension adjustment of forward-lean loop cable 38 is provided by the cooperation between ratchet buckle 80 which mounts to the medial side end of forward-lean loop cable 38 and ratchet strap 82 which is secured to the boot at the rigid calf loop in a manner described in conjunction with FIGS. 6 and 7 hereinbelow.

Figure 3:
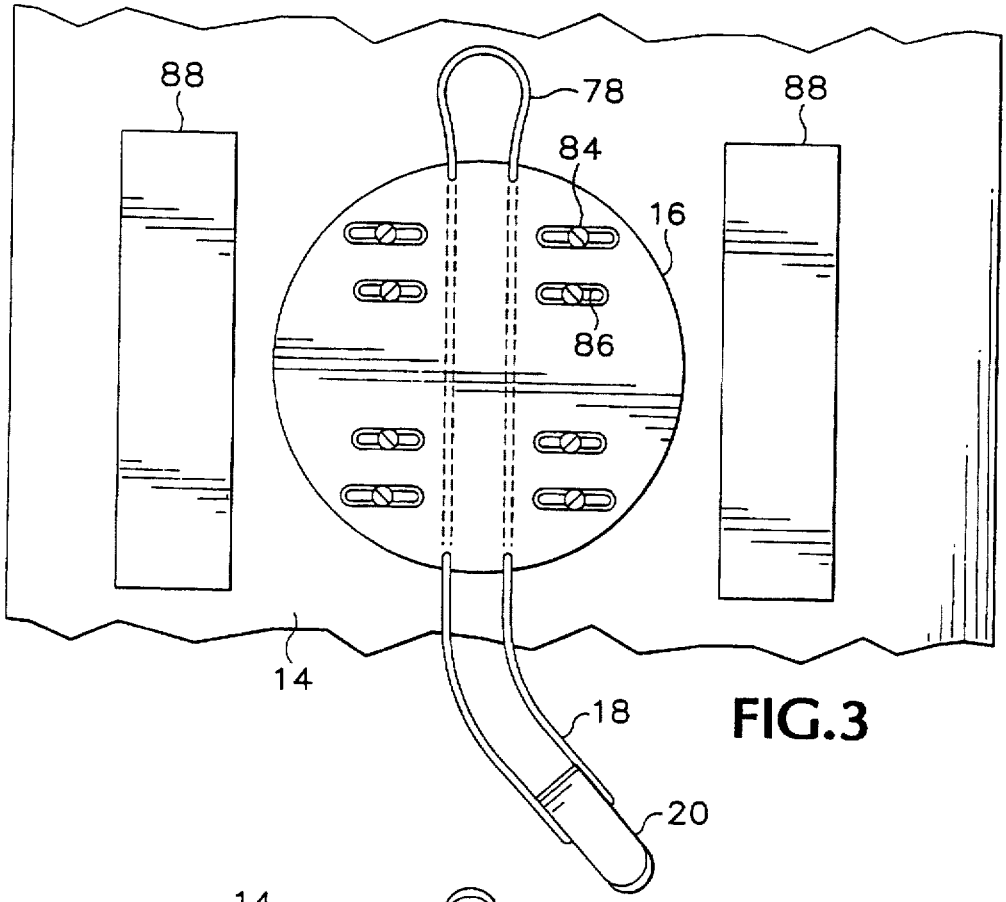
FIG. 3 is a partial view of a snowboard taken along line 3—3 of FIG. 1 illustrating an embodiment of a binding.

Referring now to FIG. 3, which is a partial view of snowboard 14 taken along line 3—3 of FIG. 1, portions of the binding system as provided on the board in an embodiment of the present invention are illustrated, wherein board 14 has mounting plate 16, which is suitably in the form of a disk shape, attached to the upper surface thereof via screws 84. The screws cooperate with a series of spaced slots 86 which are distributed about the disk 16 such that the exact positioning of the disk may shifted by loosening of the various screws and movement of the disk and the subsequent retightening of the screws. The pattern of the slots 86 may comprise a 4×4 pattern which is finding favor in the snowboard industry. The mounting cable 18, which includes mounting buckle 20, suitably passes underneath the disk such that loop portion 78 of the cable is located at an opposite edge of the disk from portion 18. Depending on the particular application, the cable may or may not be freely slidable to lengthen or shorten loop portion 78 as may be desired. Friction surfaces 88 may also be applied to the board to supply areas of greater friction on the board against which heel and toe contract points of the boot may rest so the rider has a firm contact between the boot and the board. These frictional areas may comprise, for example, somewhat dense foam portions which are adhered to the surface of the board.

Figure 4:
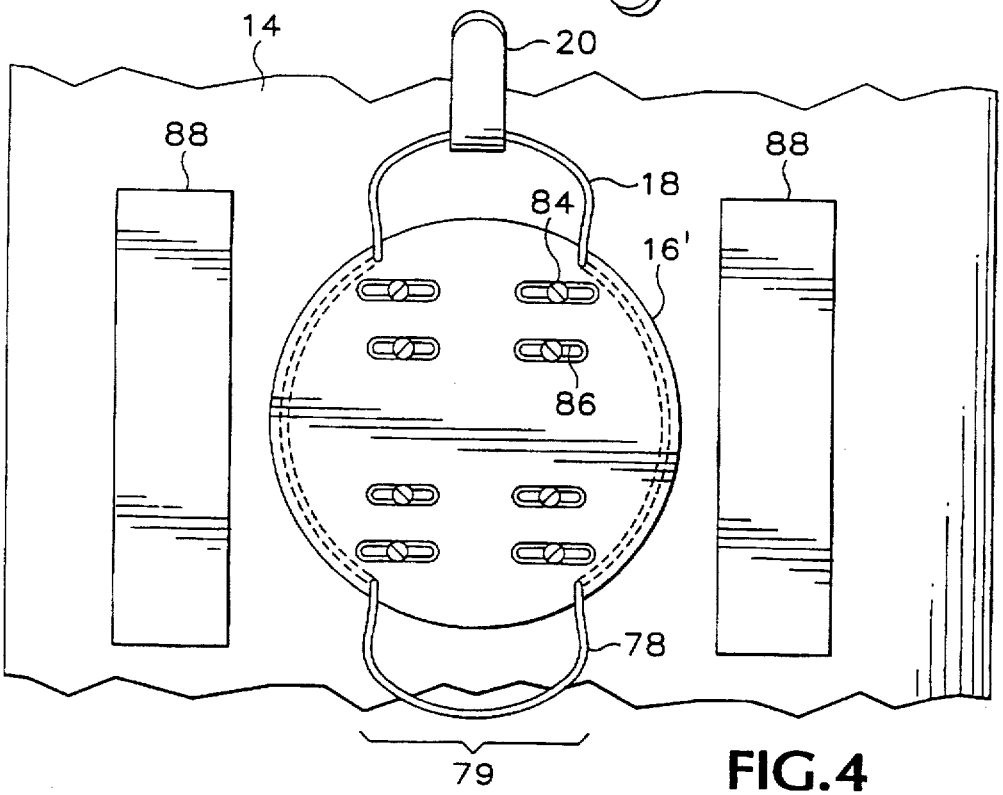
FIG. 4 is a top view of a preferred embodiment of the binding and board of FIG. 3.

FIG. 4 is a top view of a preferred embodiment of the binding and board of FIG. 3. This preferred embodiment employs a disk 16' which is modified somewhat from the disk 16 of FIG. 3, wherein cable 18 travels beneath a portion of the periphery of the disk and exits the disk in a wider stance (indicated at 79), to provide a wider attachment base.

In securing the boot-binding system to the snowboard in either the embodiment of FIG. 3 or of FIG. 4, the rider first engages loop portion 78 of the mounting cable with mounting member 76. This engaging step may comprise, for example, tilting the boot or the board slightly so as to loop the cable portion 78 over mounting member 76. A groove or the like may be provided in member 76 to receive the cable and provide an area in which the cable rides to lessen the likelihood of the cable slipping off member 76.

Figure 5:
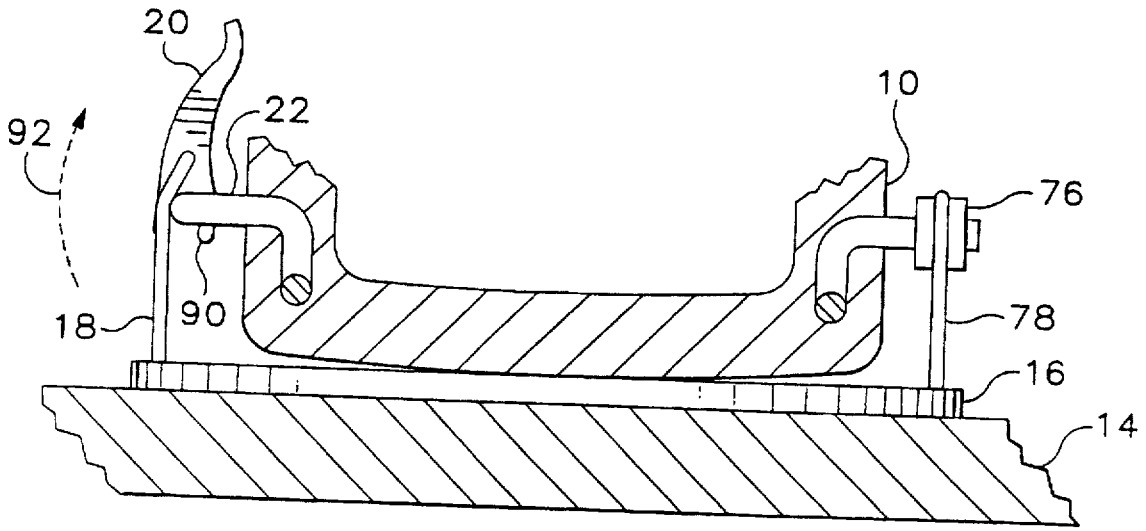
FIG. 5 is a partial cross-sectional view of the binding system taken along line 5—5 of FIG. 2.

Referring now to FIG. 5, which is a partial cross-sectional view of the binding system taken along line 5—5 of FIG. 2, the board rider next straightens the boot or board out so that the surface of the boot sole is parallel to the board surface and flat thereagainst whereupon buckle 20 is engaged with mount 22. The buckle is provided with a recess 90 which mates with a corresponding portion of mount 22. The mounting of buckle 20 to cable portion 18 is such that the cooperation between buckle 20, recess 90, mount 22 and cable 18 as well as mount 76 and cable portion 78 enables the cable to be drawn taut and subsequently pull the boot tightly against the board as the buckle 20 is flipped upwardly along the arc indicated by arrow 92 of FIG. 5. It will be noted the cable is mounted somewhat off center of the pivot axis between mount 22 and recess 90 resulting in the buckle pivoting about mount 22 and thereby drawing the cable taut when the buckle is flipped up along arc 92.

Figure 6:
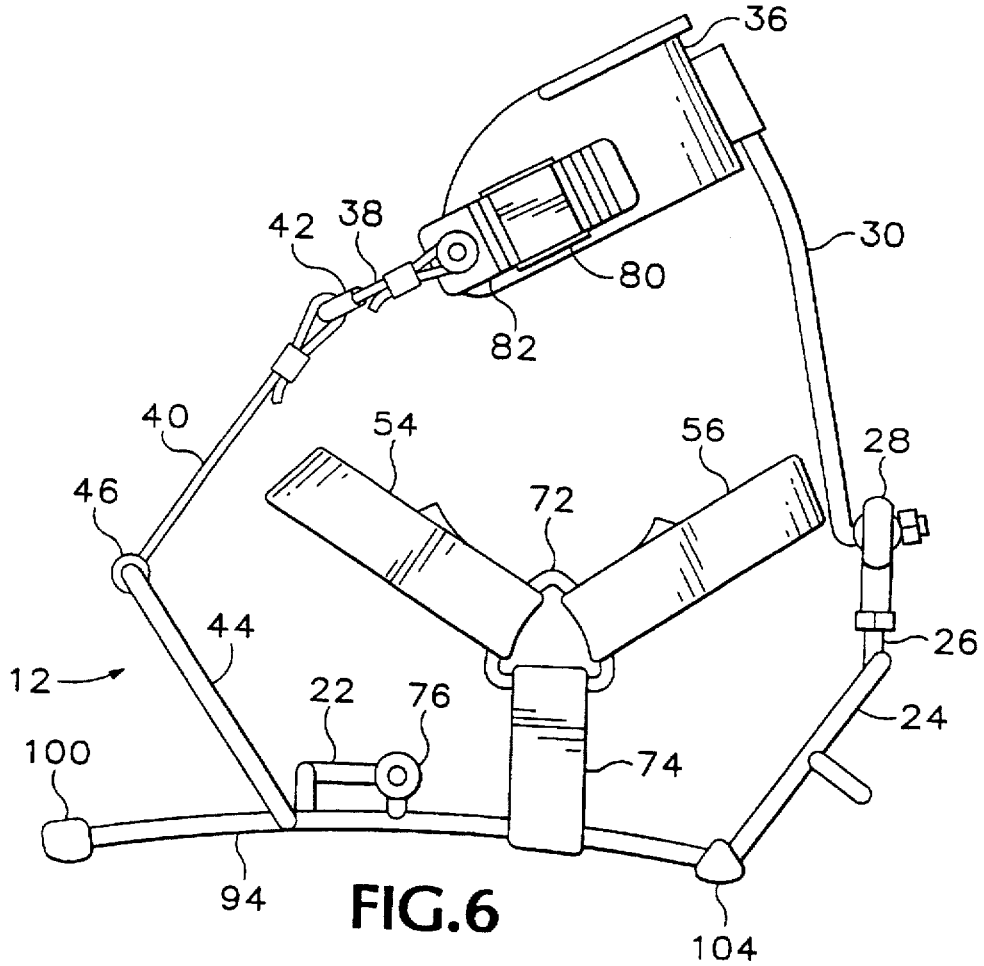
FIGS. 6 and 7 are a medial side view and a top view respectively of the binding system with the boot removed, illustrating the internal components and interaction thereof.
Figure 7:
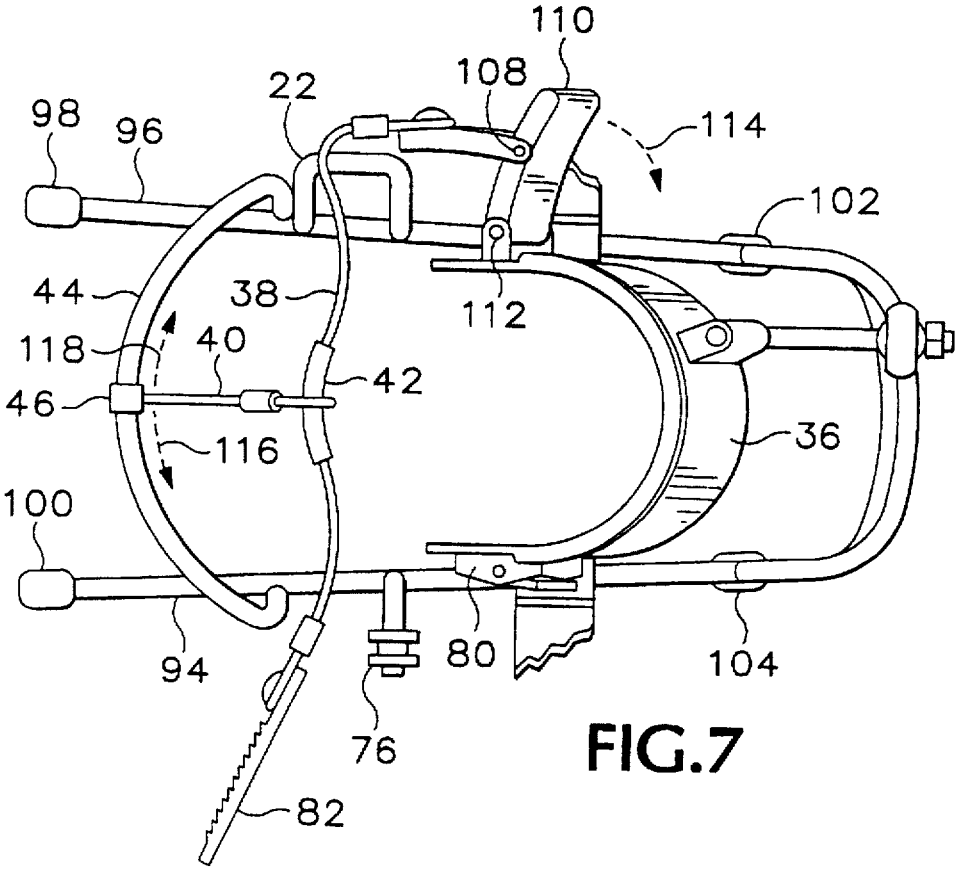

Referring now to FIGS. 6 and 7, which are a medial side view and a top view respectively of the binding system with the boot portion removed, illustrating the internal components and interaction thereof, cage portion 12 includes, in addition to the toe and heel loop portions, medial and lateral camber spring portions 94 and 96. The camber spring portions are slightly convex with respect to the board's surface. A pair of toe contact points 98 and 100 define the points where maximal force engagement between the cage portion 12 and the board surface occurs at the medial and lateral bottoms of toe loop 44 at the front of the cage while medial and lateral heel contact points 102 and 104 define the points of engagement between the board and the cage at the rear of the boot-binding system. The camber spring portions 94 and 96 connect between heel loop and toe loop portions 24 and 44, extending beyond the toe loop portion 44 to define the toe contact pad locations. The camber spring portions 94 and 96 as well as the toe and heel loop portions 44 and 24 may suitably be formed as a single piece. Somewhat forward of the centerline between the toe and heel loop portions is the attachment point for mount 22 and mounting member 76. Referring to FIG. 7 in particular, it will be observed that member 38 mounts to the rigid calf loop 36 via an off center attachment hinge 108, which hingedly engages lever member 110. An end of lever 110 that is distal from hinge point of hinge 108 is hingedly mounted to the rigid calf loop 36 via hinge member 112.

Figure 15:
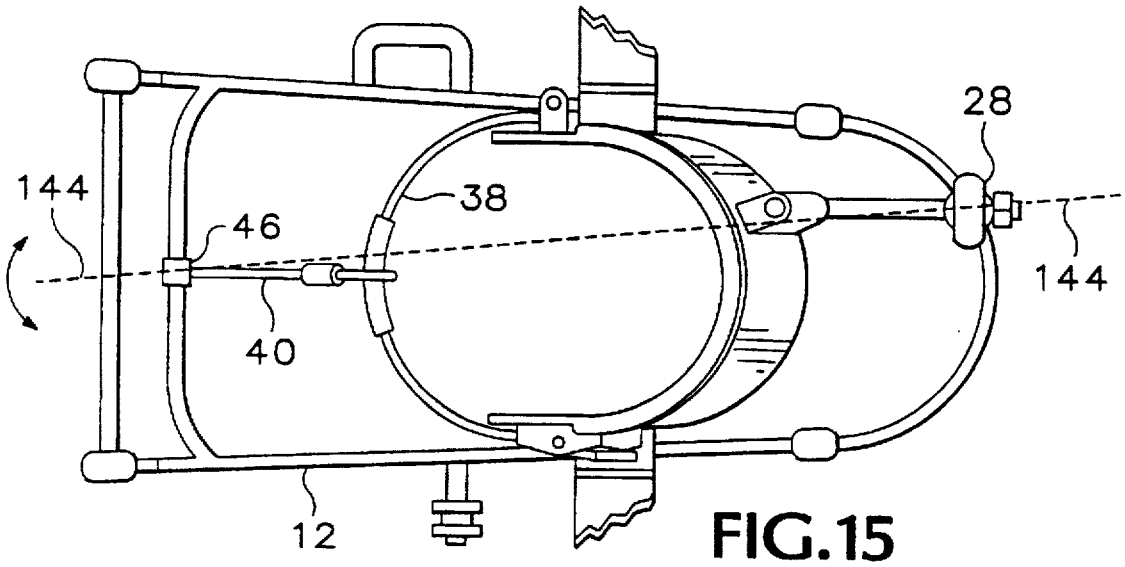
FIG. 15 is a top view of a portion of the binding system illustrating a fold line.

The functional operation of the binding system is such that upon engagement of the cable portion 78 with member 76 and buckle 20 with member 22, the tightening of the cable causes tension to be applied to the camber spring portions 94 and 96, ensuring firm force engagement between the binding system and the board at points 98, 100, 102 and 104. The user adjusts the forward lean to the degree desired so as to define at what angle the rider is forwardly leaning during riding by adjustment of the engagement between ratchet strap 82 and ratchet 80. As ratchet strap 82 is inserted further through ratchet 80, the subsequent setting of lever member 110 by movement in the direction of arrow 114 (FIG. 7) will result in a more forward pull as defined by cable 40, thus determining the degree to which the rider must lean backward before upward pulling is applied by cable 40 to the toe loop 44. The attachment point of toe loop cable 40 to the toe loop 44 is defined by the position of toe loop cable lock 46. The cable lock is adapted to translate to any position along the toe loop as indicated by arrows 116 and 118 of FIG. 7. The cable is then locked by any suitable means wherein locking member 46 may be easily moved to any different position but remain in that position until the user slides the attachment point to a different location. The binding system acts somewhat as a large hinge wherein cable 40 as well as highback post 30 correspond in function to the pintle of a hinge, pivoting on the lock position 46 and joint 28. The cooperation among these elements enables natural lateral movement and medial movement as allowed by the rider's ankle, without unduly hindering these movements. Referring to FIG. 15, a top view of a portion of the binding system, the cooperation between the various elements results in a fold line 144 (somewhat equivalent to the pintle of a hinge) along which the rider is able to flex laterally and medially while riding the snowboard. Adjustment of lock position 46 changes the forward position of fold line 144, altering the "fold" characteristics. Further, altering the length of cable 38 by changing ratchet strap 82 will also alter the pivoting characteristics of the binding system, by effectively shortening the length of the "pintle".

When a rider leans backwardly, the backward leaning force is applied through highback member 30 and spine post 26, directing the force into the heel loop of the binding system and subsequently into the board at contact points 102 and 104. Similarly when the user attempts a forward leaning maneuver, the forward leaning force is applied to the board through points 98 and 100.

The medial and lateral tension is adjustable by use of straps 60 and 62, wherein tightening or loosing of the adjustment of these straps through the cooperation of the straps and friction buckles 64 and 68 controls the "looseness" or "stiffness" of the boot binding to medial and lateral leaning. Accordingly, a rider is able to adjust the binding and boot to enable fine tuning for whatever type of maneuver or skill lever of the rider. It will be noted that straps 60 and 62 form a type of criss-cross pattern at the front of the boot.

Figure 8:
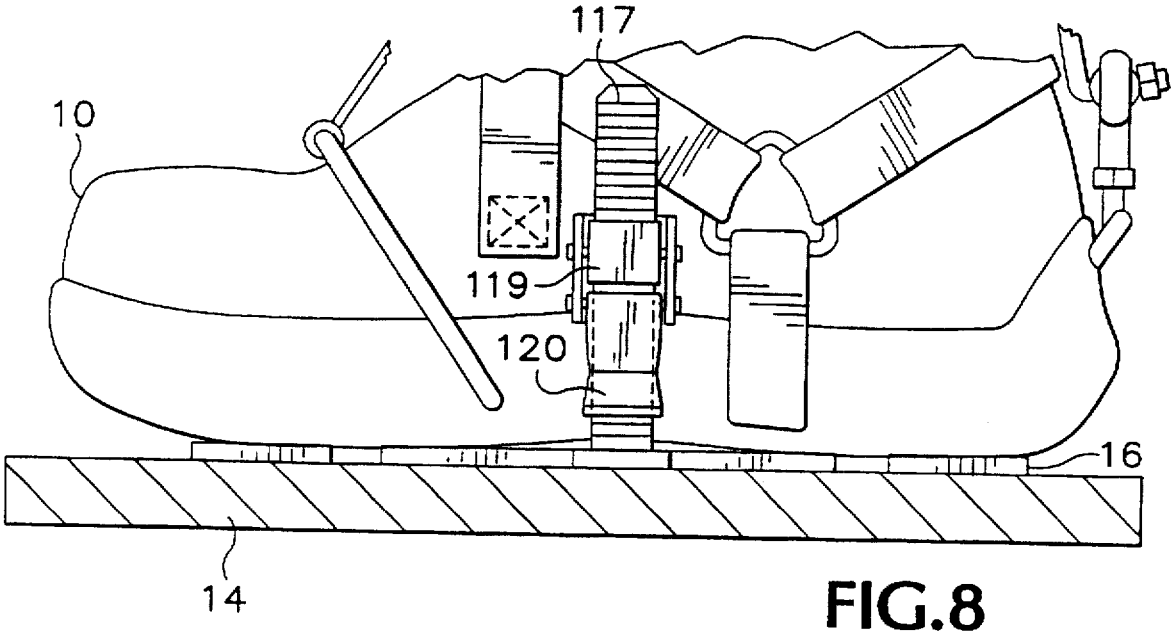
FIG. 8 illustrates an alternative attachment system for providing firm engagement between the board and boot-binding system.

FIG. 8 illustrates an alternative attachment system for providing firm engagement between the board and boot-binding system. In this embodiment, cable portions 18 and 78 as well as mounting buckle 20 and member 76 are not employed. Instead, medial and lateral ratchet straps 117 are provided on the board and corresponding ratchet buckles 119 are mounted at both lateral and medial sides of the boot. The user then attaches the boot to the board merely by inserting the ratchet strap 116 into its mating ratchet buckle 118 and stepping downwardly. The engagement between the ratchet strap and the buckle then secures the boot to the board. To disengage the boot from the board, the user merely lifts up on the release lever 120 of the ratchet buckle and the ratchet strap is then allowed to slide out of the buckle as the user lifts upwardly on the boot.

A further embodiment employs an attachment system wherein the mounting cage 12 is secured to the board at each of toe and heel contact points 98, 100, 102 and 104. In such a system, the portions 94 and 96 do not require camber and instead may suitably be straight members, if desired. Other suitable step-in binding attachments may also be used.

Figure 9:
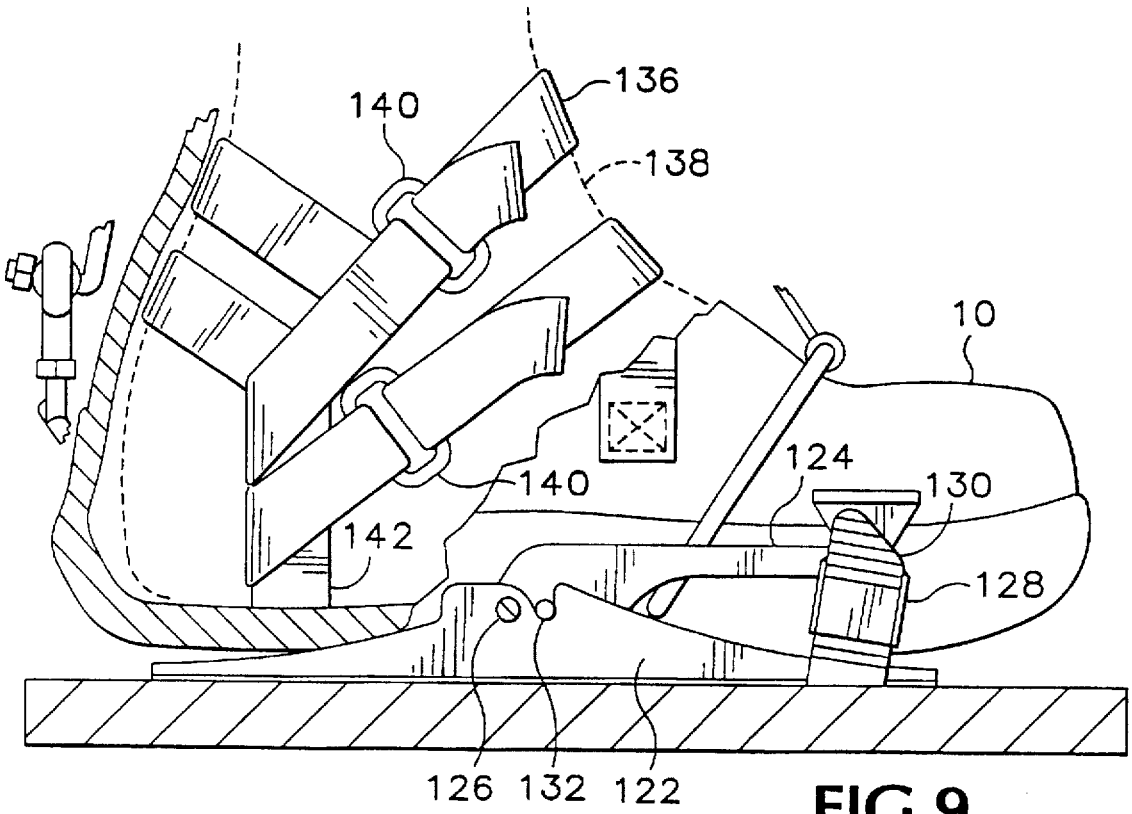
FIG. 9 is a partial cut-away view from the lateral side of an alternative attachment system for securely engaging the binding system to the snowboard and illustrating the internal tie down system.
Figure 10:
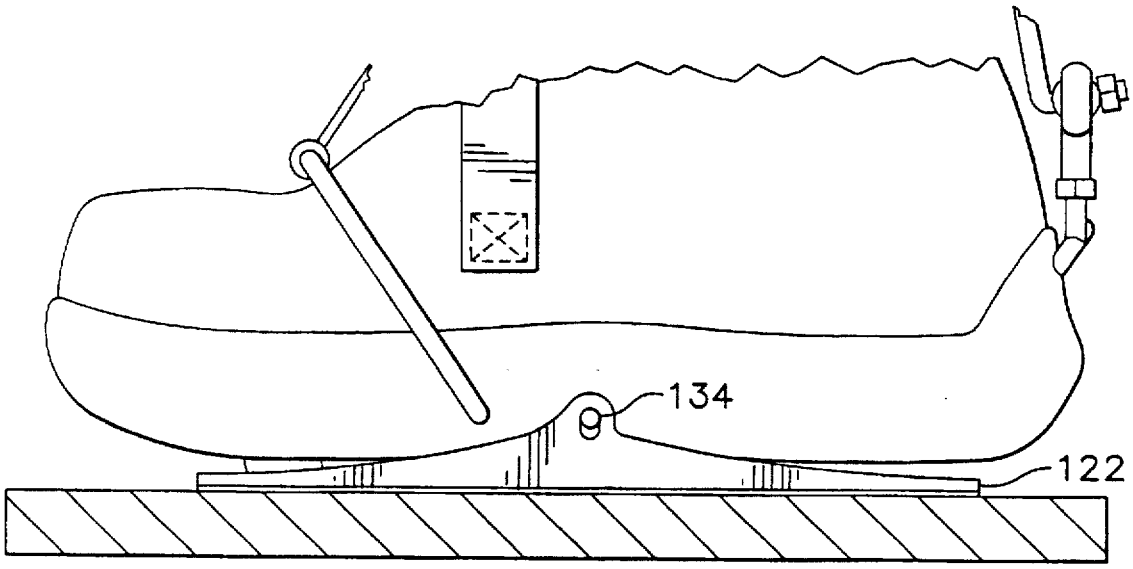
FIG. 10 is a medial side view of the alternative attachment system of FIG. 9.
Figure 11:
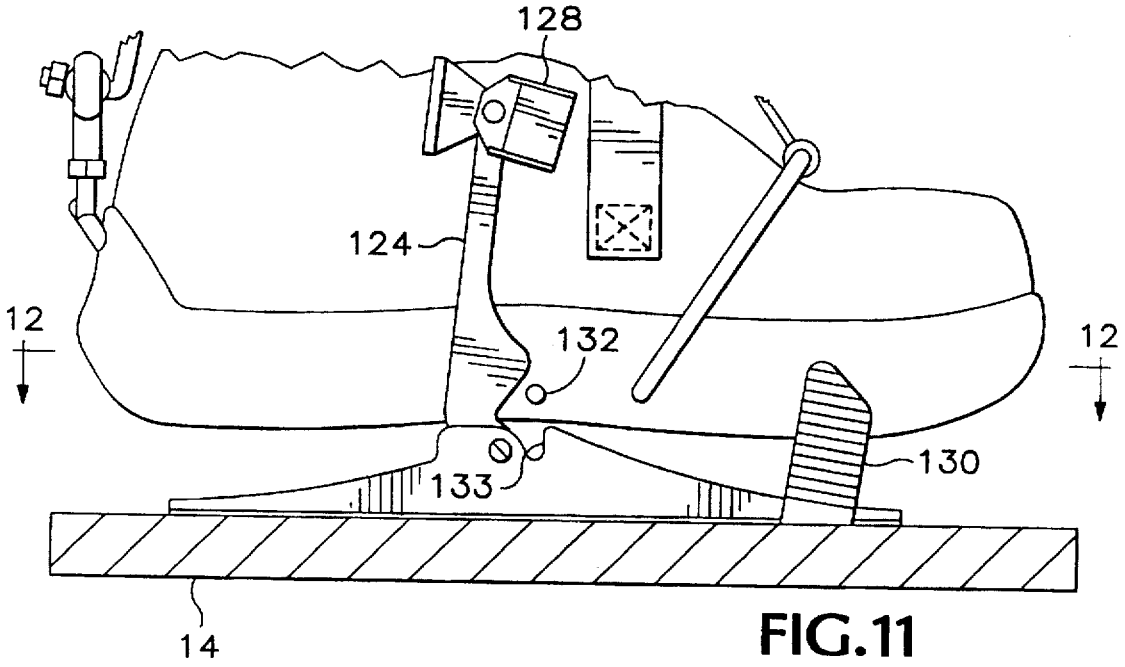
FIG. 11 is a lateral side view of the system of FIG. 9 with the engagement arm in a raised position.

Referring to FIGS. 9–13, a still further embodiment will be shown and described. FIG. 9 is a partial cut-away view from the lateral side of the further attachment system for securely engaging the binding system to the snowboard. In this system, a binding plate 122 is secured to the board by means shown and described hereinbelow with reference to FIGS. 12 and 13. Binding plate 122 includes binding arm 124, pivotally mounted to plate 122 via pivot member 126. A ratchet clip 128 is provided at the end of arm 124 distal from pivot member 126, wherein a corresponding ratchet strap portion 130 is positioned on binding plate 122, oriented so as to be engaged with ratchet clip 128 when arm 124 is in a lowered position. A binding pin 132 extends laterally outward from the boot 10, and is engaged by the cooperation between arm 124 and a receiver portion of plate 122. The tightness of the engagement is determined by the number of clicks which arm 124 is pushed down onto ratchet strap 130. Referring to FIG. 10, a medial side view of the attachment system of FIG. 9, plate 122 has an aperture which receives medial binding pin 134, a portion of binding cage 12 which extends laterally outward from the boot. Pin 134 is curved slightly upwardly such that in use, to engage the binding with the boot, a user releases clip 128 and raises arm 124, as illustrated in FIG. 11, a lateral side view of the system of FIG. 9 with the engagement arm in a raised position. Next, pin 134 is inserted into the corresponding aperture in the binding plate and the user steps down into the binding, such that pin 130 rests in the corresponding slot 133 of the binding plate. Now, arm 124 is lowered to engage the ratchet clip with the ratchet strap and is pushed further downwardly by the desired number of clicks to provide the desired engagement between the binding and plate.

Figure 12:
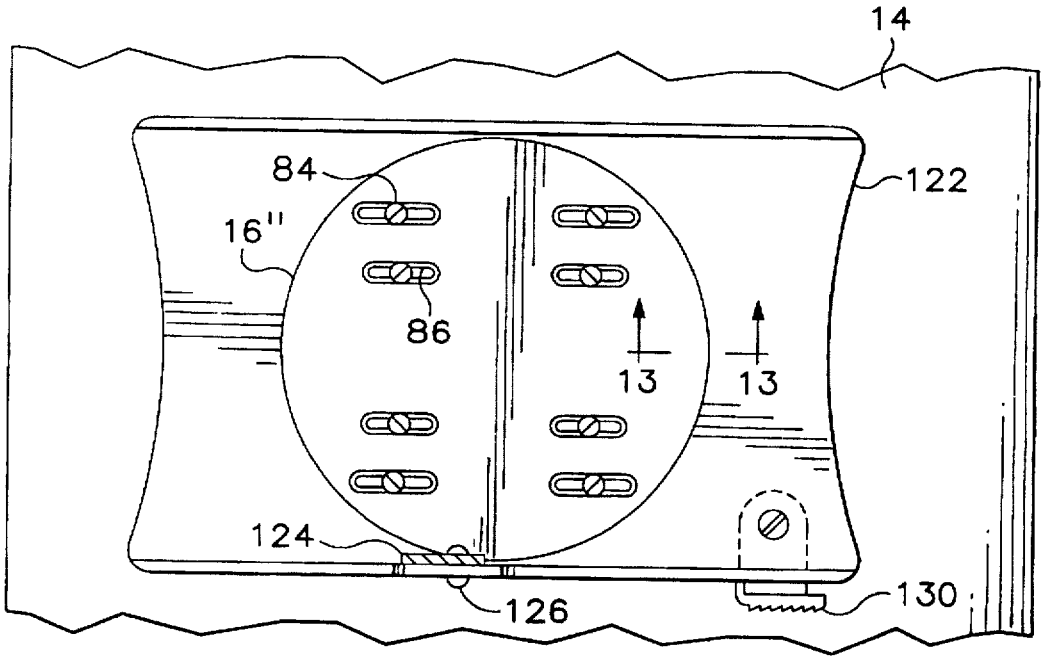
FIG. 12 is a partial view of a snowboard taken along line 12—12 of FIG. 11.
Figure 13:
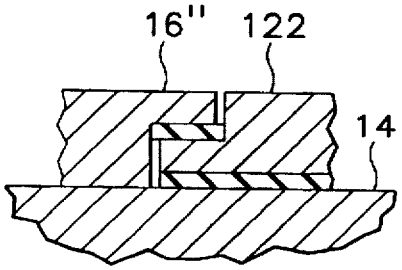
FIG. 13 is a sectional view taken along line 13—13 of FIG. 12 illustrating the engagement between the disk and frame.

Referring now to FIG. 12, a partial view of a snowboard taken along line 12—12 of FIG. 11, it may be observed that binding plate 122 has a circular aperture in the center thereof, suitably dimensioned to receive a mounting disk 16" therewithin, such that disk 16", as secured to the snowboard by the cooperation of screws 84 with a series of spaced slots 86 which are distributed about the disk, engages plate 122 around the periphery of the disk, holding the plate to the board. FIG. 13, a sectional view taken along line 13—13 of FIG. 12, illustrates the engagement between the disk and plate, wherein the disk employs an overlapping portion which overlays and engages a recessed portion of the plate.

Referring further to FIG. 9, the partial cut-away view illustrates the internal tie down system employed within boot 10, wherein a series of tie down straps 136 surround and engage the rider's foot 138 (shown in phantom). The straps employ rings 140, which may comprise friction type buckles or D-rings with corresponding hook and loop fastener material provided on the straps. An anchor strap 142 secures straps 136 to the boot or to frame 12.

Figure 14:
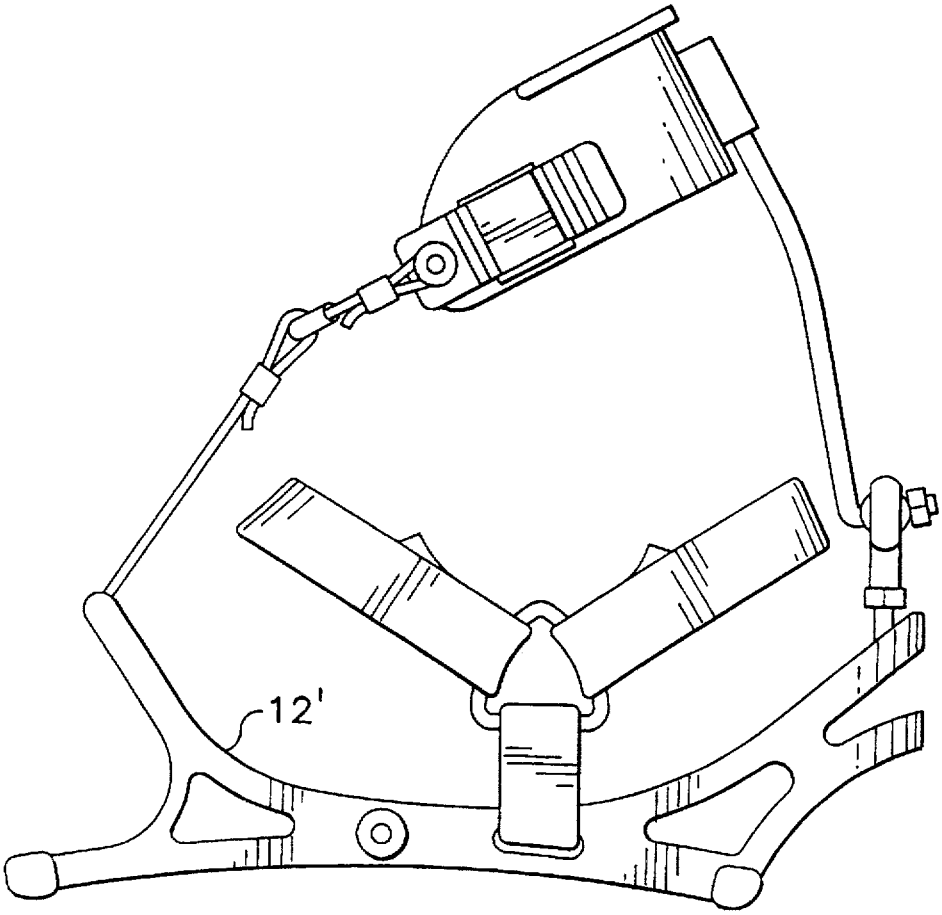
FIG. 14 is a medial side view of an alternative binding system with the boot removed, illustrating portions of the internal components and interaction thereof.

FIG. 14 is a medial side view of an alternative binding system with the boot removed, wherein frame portion 12' is suitably formed as a single piece of metal, plastic or the like. Frame 12' has a somewhat narrower but taller profile as compared with frame 12 of FIGS. 6 and 7, for example.

The invention accordingly provides a binding system which is highly adjustable to enable customizing to a particular rider's skill level and riding style. The system also enables use of a single board by multiple riders without changes to the binding system. Heretofore, each binding was custom oriented to a particular rider's stance. In accordance with the present invention, in order to adjust the stance, the length of loop portion 78 and portion 18 of the attachment cable, for example, is merely changed by sliding the loop portion inwardly or outwardly with respect to disk 16 (FIG. 3, FIG. 4). The user is then able to adjust to a desired stance before latching the boot and binding system to the board. Thus a single board may used by multiple riders.

The boot and binding system of the present invention further enables adjustment of the forward lean to a degree desired by a particular rider, as well as adjustment of the stiffness of medial and lateral stiffness of the boot. The forward attachment point of the forward lean cable is also variable so as to enable the action of the binding/board in cooperation to be adapted to a particular rider's style. Thus, the binding is adaptable to varying maneuvering and riding styles. The cooperation of straps 50, 54, 56 and 74 in engagement with the frame system 12 enable the boot to be more or less securely engaged at the front and heel faces thereof. The design and arrangement of the structural frame system enables a more comfortable boot to be employed; since the boot does not require a rigid sole to cooperate with the binding, the rider's foot is not isolated from the board by a stiff sole plate between the bottom of the foot and the sole of the boot. The rider is therefore able to "feel" the board better.

The binding in accordance with the present invention therefore employs two essential force systems in conjunction with the boot, the toe side turn force system and the heel side turn force system. These two force systems depend on whether the rider is "pivoting" on the heel or the toe portion of the binding system. With a heel side turn, the highback post applies force downwardly into the heel contact points while force is also applied to the cable to the toe loop which pulls upwardly on the camber springs, which then apply the force to the toe contact points. This force is not a perpendicular force so some of the force is applied downwardly to the highback post. The ball joint enables side-to-side flexing and some forward flexing but, due to the cabling arrangement, no backward force (beyond the point of cable tautness) occurs. The heel side turn force also goes down the highback post, partially as a result of the rigid calf loop which does not tend to compress or bend substantially when the rider leans backwardly thereagainst.

For toe side turns, as the rider pivots forwardly on the ball of the foot and lifts the heel upwardly, the cooperation of straps 54, 56 through D-ring 52 and strap 50 lift upwardly on the heel portion of the binding system.

The boot employed is a typical snowboard boot, and may employ a liner inside. The rider's foot essentially floats within the boot wherein the frame system 12 acts as a type of roll cage. The forces from movement of the user's foot and body are applied to the binding system through the engagement between the boot and the frame system or through the straps 50, 54 and 56 or through the medial and lateral flex adjustment straps to the frame system, whereby the force is applied to the board at the contact points through the mounting cables to the mounting plate on the board and subsequently to the board. Structural cage 12 is suitably constructed of metal, e.g., aluminum, but may also be plastic, carbon fiber based or of any other suitable structural material. While illustrated as being somewhat internal of the boot, frame 12 may also be external to the boot or completely internally located. The frame may further employ rigid cross members extending between the medial and lateral sides of the frame at the heel and/or toe contact points.

Accordingly, the improved binding system of the present invention enables a soft boot to be employed without the undesirable inclusion of a rigid sole plate therein. The rider's foot is thus closer to the board, providing a lower center of gravity. Also, the rider is better able to "feel" the board and is able to enjoy a lighter weight boot that is more pleasant to walk in when disconnected from the snowboard.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A binding system for securing a rider to a snowboard comprising:

a boot for receiving a foot of the rider; and a binding cage to which said boot is secured, said cage adapted for securing to the snowboard, wherein said binding cage comprises a front contact portion and a rear contact portion providing contact positions to a surface of the snowboard and wherein said binding cage further comprises a camber spring portion between said front contact portion and said rear contact portion.

2. A binding system according to claim 1 wherein said binding cage further comprises a mounting member adapted to engage with the snowboard wherein said camber spring portion is put into tension when said mounting member is engaged with said snowboard.

3. A binding system for securing a rider to a snowboard comprising:

a boot for receiving a foot of the rider, wherein said boot comprises a flexible sole; and a binding cage formed as an integral part of said boot, said cage adapted for securing to the snowboard, wherein said binding cage comprises a front contact portion and a rear contact portion providing contact positions to a surface of the snowboard, and wherein said binding cage further comprises a substantially rigid side portion between said front contact portion and said rear contact portion.

4. A binding system for securing a rider to a snowboard comprising:

a boot for receiving a foot of the rider, wherein said boot comprises a flexible sole;

a binding cage formed as an integral part of said boot, said cage adapted for securing to the snowboard, and an adjustable attachment member for enabling shifting of a frontal pivot position of the binding system along a line traversing between a position on a medial side of the binding system and a position on a lateral side of the binding system.

5. A binding system for securing a rider to a snowboard comprising:

a boot for receiving a foot of the rider, wherein said boot comprises a flexible sole;

a binding cage formed as an integral part of said boot, said cage adapted for securing to the snowboard, and front and rear pivot positions for defining a medial and lateral flexing axis of said binding system, wherein said front pivot position comprises an adjustment member enabling translation of the front pivot position as desired by the rider.

6. A binding system for securing a rider to a snowboard comprising:

a boot for receiving a foot of the rider, wherein said boot comprises a flexible sole;

a binding cage formed as an integral part of said boot, said cage adapted for securing to the snowboard; and means for altering bending characteristics of said binding system, wherein said means for altering bending characteristics of said binding system comprises a medial lean adjustment system for altering medial lean characteristics.

7. A binding system for securing a rider to a snowboard comprising:

a boot for receiving a foot of the rider, wherein said boot comprises a flexible sole;

a binding cage formed as an integral part of said boot, said cage adapted for securing to the snowboard; and means for altering bending characteristics of said binding system, wherein said means for altering bending characteristics of said binding system comprises a lateral lean adjustment system for altering lateral lean characteristics.

8. A binding system for securing a rider to a snowboard comprising:

a boot for receiving a foot of the rider, wherein said boot comprises a flexible sole;

a binding cage formed as an integral part of said boot, said cage adapted for securing to the snowboard, and means for adjusting hinging characteristics of said binding system to enable altering of a medial and lateral flexing axis along which said binding system flexes medially and laterally.

9. A binding system for securing a boot to a snowboard comprising:

a binding cage adapted to be secured to the boot, said binding cage including a toe loop portion which substantially surrounds a toe region of the boot; and means for securing said binding cage to the snowboard;

wherein said binding cage further comprises a highback member extending upwardly from a heel portion of said binding cage for directing backward force from a rider's movement into said binding cage, a forward lean system for defining a degree of forward lean of the rider and for applying backward force from the rider's movement to a front portion of said binding cage for applying upward force thereto, and medial and lateral lean stiffness adjustment means for enabling modification of the stiffness of the binding system to medial and lateral leaning of the rider.

10. A binding system according to claim 9 further comprising forward and rear engagement members for engaging forward and rear portions of the boot, wherein said forward and rear engagement members are further secured to said binding cage, thereby securing the binding cage to the boot.

* * * * *